United States Patent [19]

Ichiryu et al.

[11] 4,038,848

[45] Aug. 2, 1977

[54] METHOD AND APPARATUS FOR CONTROLLING ECCENTRICITY OF ROLLS IN ROLLING MILL

[75] Inventors: Ken Ichiryu, Mito; Masayuki Shigeta, Katsuta; Toyotsugu Masuda; Haruo Kinoshita, both of Hitachi, all of Japan

[73] Assignee: Hitachi, Ltd., Japan

[21] Appl. No.: 581,774

[22] Filed: May 29, 1975

[30] Foreign Application Priority Data

May 31, 1974 Japan ..... 49-60827

[51] Int. Cl.[2] ..... B21B 37/00

[52] U.S. Cl. ..... 72/8; 72/21

[58] Field of Search ..... 72/8, 21, 11

[56] References Cited

U.S. PATENT DOCUMENTS

| | | | |
|---|---|---|---|
| 3,460,365 | 8/1969 | Howard | 72/21 |
| 3,543,549 | 12/1970 | Howard | 72/8 |
| 3,709,009 | 1/1973 | Shiozaki et al. | 72/8 |
| 3,792,360 | 2/1974 | Carlow | 328/27 |
| 3,881,335 | 5/1975 | Cook | 72/11 |
| 3,882,705 | 5/1975 | Fox | 72/11 |

*Primary Examiner*—Milton S. Mehr

*Attorney, Agent, or Firm*—Craig & Antonelli

[57] ABSTRACT

A roll eccentricity control apparatus for use with an automatic gage control device of gage meter type for a rolling mill comprising rolls for rolling the material to be rolled, a hydraulic jack for providing the rolls with rolling pressure, a flow rate control valve and a valve control device for adjusting the roll gap by controlling the quantity of oil in the hydraulic jack, a setting device for applying a desired gage command to the valve control device and a gap detector for detecting the roll gap and feeding back the detected value to the valve control device; said apparatus comprising a correlation detector for detecting the correlation between the rolling pressure and a reference signal wave obtained from a roll rotation signal, a memory for storing the output of the correlation detector, and a device for retrieving the correlation output stored in the memory by the use of a signal associated with the rotation of the rolls and applying a command to the gate control device.

14 Claims, 7 Drawing Figures

METHOD AND APPARATUS FOR CONTROLLING ECCENTRICITY OF ROLLS IN ROLLING MILL

BACKGROUND OF THE INVENTION

1. Field of the Invention

This invention relates to a method and apparatus for controlling the gage of the material in a rolling mill, or more in particular to a method and apparatus to compensate for the eccentricity of rolls in a rolling mill.

2. Description of the Prior Art

Today, there is an increasing demand for high precision in the thickness of rolling mill products, and the automatic gage control system of gate meter type built around what is called BISRA-AGC (Automatic Gage Control developed by the British Iron & Steel Research Association) has made rapid progress.

This automatic gage control system of gage meter type is almost necessarily provided for controlling the thickness of the material in the rolling mill and arranged to control the desired gage *hd*, the roll gap S at no load, the rolling pressure P and mill constant K*m* in such a manner as to satisfy the equation $$hd - (S + P/Km) = 0$$

In the automatic gage control system of the gage meter type, however, it is impossible to maintain the roll gap constant and therefore to achieve the objects of the gage control if there is an eccentricity of any of the rolls. In other words, the above-mentioned control system of gage meter type is such that any increase in the rolling pressure is considered to be caused by an increase in input gage and acts to reduce the no-load roll gap S. This ignores the fact that in the event of the roll gap being reduced by roll eccentricity, the rolling pressure is also increased, thus undesirably further reducing the rolling gap. Therefore, the elimination of the effect of the roll eccentricity is an important problem to be solved in the automatic gage control system of gage meter type.

Various methods for solving this problem have been suggested in the past. Many of them, however, are too complicated in construction or low in precision to be used widely, with the result that the gage is generally controlled in reliance upon the skill of the operator. In the simplest one of such methods, as an example, the automatic gage control system is so constructed that a filter for passing only a component of the roll eccentricity cycle fe is inserted in the feedback loop of the rolling pressure controlling circuit thereby to eliminate the component of the roll eccentricity cycle fe from the feedback signal, so that the eccentricity component does not affect the roll gap. This method, however, has the disadvantages that; (1) since the components of a frequency fe in the rolling pressure variation are regarded as roll eccentricity components and allowed to pass, the gage variation component of the same frequency fe as the roll eccentricity is passed, resulting in a larger gage variation without any correction; (2) what is called the resonance type filter which resonates with the roll eccentricity frequency fe allows to pass components near the resonance frequency band, thereby to pass not only the signals to be passed but other signals in the neighborhood thereof.

Another method which has been suggested in the past for gage control is based on a hypothetical position of occurrence and frequency of a roll eccentricity. In other words, it is assumed that the roll eccentricity occurs in the back-up rolls at the frequency of fe and the detected frequency component of the roll eccentricity is assumed to represent all the roll eccentricity. The detected waveform is subjected to Fourier analysis thereby to pick up only the roll eccentricity frequency component which is used to correct the roll eccentricity component in the gage control system.

Nevertheless, it is generally true that the disturbances in the roll system occur also in the work rolls, and, in a complex pattern including high frequencies. For this reason, the above-mentioned methods for detecting and correcting one roll eccentricity component only fails to attain a satisfactory accuracy.

SUMMARY OF THE INVENTION

Accordingly, it is an object of the present invention to provide a highly accurate method and apparatus for gage control in the rolling mill whereby the roll eccentricity components are properly grasped and the effect of the roll eccentricity components on the gage control system of gage meter type is eliminated.

In order to achieve the above-described objects, the present invention is characterized in that a digital or analog correlation between the input of unknown phenomena such as the rolling pressure and the roll gap displacement, which may include the roll eccentricity, and a reference wave taken out of the rotation signal of the rolls, is detected in real time and negatively fed back to a command circuit of a reduction control system thereby to dynamically compensate for the roll eccentricity, thus providing a highly accurate, highly stable and highly responsive method and apparatus for roll eccentricity control.

According to another aspect of the method of roll eccentricity control of the invention, the rotation pulse signal in synchronism with the rotation of the rolls is converted into a cosine wave. The correlations of the rolling pressure and the roll gap with reference to the cosine wave are determined and sequentially stored in a plurality of memories. Further, the contents of the memories i.e. the correlations, are sequentially delivered in synchronism with the roll rotation, which content are used to control the roll gap.

In other words, the feature of the method for gage control according to the invention lies in that a cosine wave in synchronism with the rotation of the rolls is used as a reference and the registration of the unknown phenomena and delivery thereof to the control system are effected in synchronism with the rotation of the rolls. For the purpose of delivering the stored information to the control system in real time, a plurality of memories are provided for storing the outputs from the correlation detector for alternately performing the input and output operations of the memories.

More specifically, the pulses of the roll rotation signal are applied to a pulse counter which counts the pulses and produces a trigger pulse each time when its count reaches a number corresponding to the number of words of a calculation output memory of the correlation detector. The output from the pulse counter is converted into a cosine wave in a read-only memory, thus producing a reference wave. Next, the correlation between the reference input and the input of the unknown phenomena is obtained, so that a cycle of phenomena is applied to the calculation ouput memory. Further, the calculation output memory is connected to a plurality of memories, and the information stored in the calculation output memory are distributed sequentially. The delivery of information from the memories is controlled by clock pulses produced from the pulse counter, while the starting of delivery is controlled by the trigger pulse. In this way, the cyclical component contained in the phenomena which is identical with the reference wave, namely, the roll eccentricity component is collected and converted into an analog signal by a D-A converter in real time which is utilized as a control signal.

DETAILED DESCRIPTION OF THE PREFERRED EMBODIMENTS

Specific embodiments of the invention will be described below with reference to the accompanying drawings.

Figure 1:
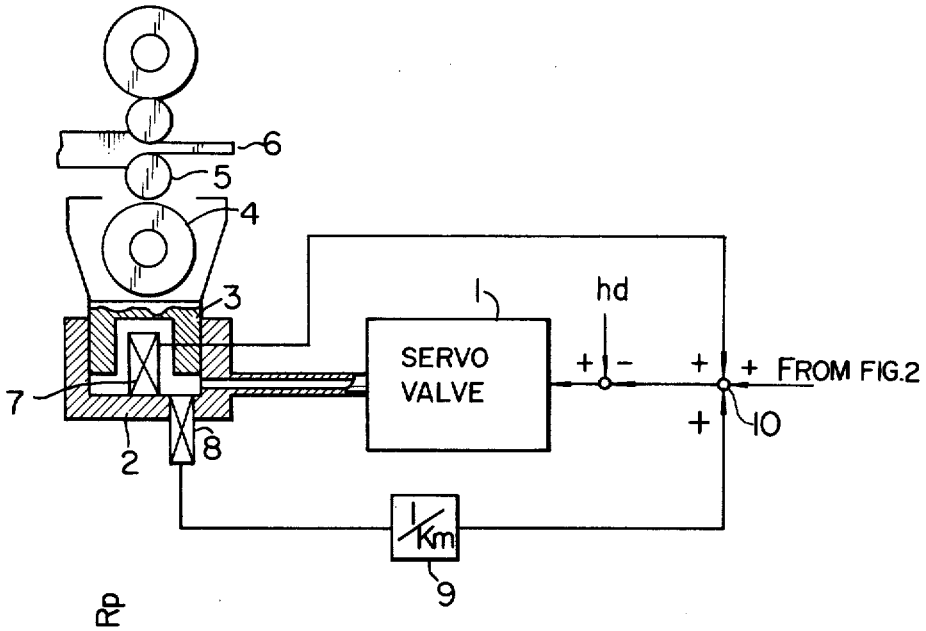
FIG. 1 is a schematic diagram showing the automatic gage control system of gage meter type.

The outline of the automatic gage control system of gage meter type is shown in FIG. 1. In the drawing, the rolling mill comprises work rolls 5 for rolling directly a material 6 to be rolled and backup rolls 4 for supporting the work rolls 5. Oil under pressure is supplied through a servo valve 1 to a hydraulic cylinder 2, so that the rolling pressure is generated by the operation of the ram 3 in the cylinder 2 while at the same time adjusting thr roll gap for successful rolling. For performing gage control in this rolling mill, the displacement S of the ram 3 is measured by the displacement meter 7 and negatively fed back to the gage command *hd* on one hand, while the rolling pressure P is measured by the pressure gage 8 (in other case, the rolling pressure is measured by the load cell which is located between upper back up roll choke and housing. The control method is same with the pressure gage.) and, after being divided by the mill constant K*m* in the coefficient generator 9, fed back to an adding point 10. By this process, the control operation is performed on the basis of the above-mentioned measurements and values in such a manner as to satisfy the relation $hd - (S + P/Km) = 0$, thereby maintaining a constant thickness of the material rolled.

It was already mentioned that the aforementioned automatic gage control system of gage meter type is incapable of maintaining the roll gap constant in the presence of an eccentricity of any rolls. In order to solve this problem, the present invention provides means for applying a roll eccentricity component to the gage command *hd* such that unknown phenomena such as the output gage and the rolling pressure involving the roll eccentricity components are measured and, from the results of the measurement, a real roll eccentricity component is detected on the basis of statistical techniques utilizing the correlation and fed back through the adding point 10, as shown in FIG. 1, to the gage command for eliminating the effect of the eccentricity.

Figure 2:
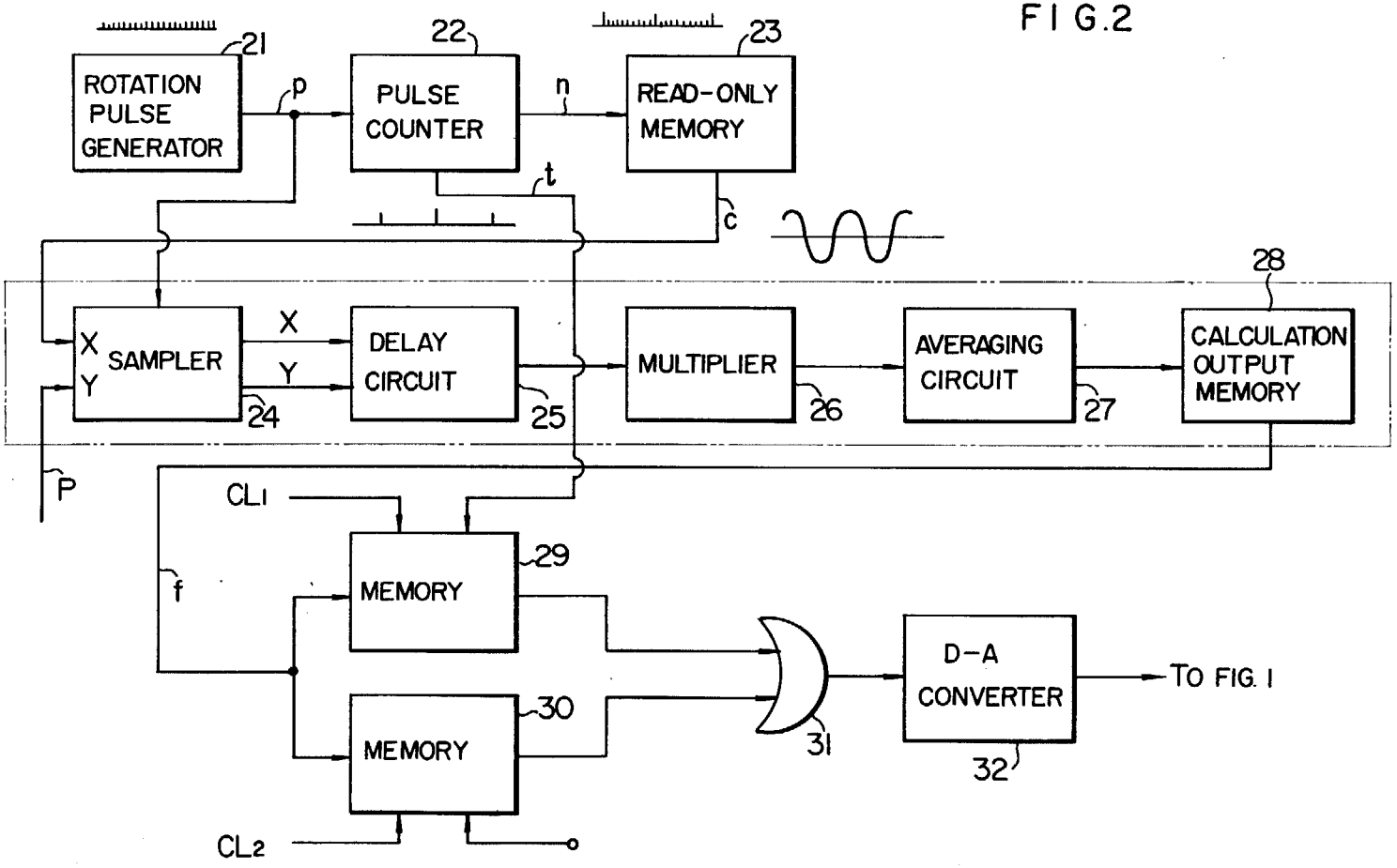
FIG. 2 is a block diagram showing a method of roll eccentricity control according to an embodiment of the invention.

The diagram of FIG. 2 shown various devices in the form of blocks for detecting the roll eccentricity components from the inputs of unknown phenomena and applying the roll eccentricity component to the gage control system of gage meter type. In the drawing under consideration, reference numeral 21 shows a rotation pulse generator mounted on the roll neck for generating a signal in synchronism with the rotation of the rolls. The pulses P produced from the rotation pulse generator 21 are counted by the pulse counter 22.

The pulse counter 22 counts the pulses from the rotation pulse generator 21 and produces a trigger pulse $t$ each time of completion of counting $n$ pulses, and returns to "1", where $n$ is the number of memories included in the calculation output memory 28 of the correlation detector as described later. The read-only memory 23 is for converting each train of $n$ pulses received from the pulse counter 22 into one cycle of a cosine reference wave C, and has addresses 1 to $n$ where signals representing the amplitudes of respective points of one cycle of the cosine wave are written. When the addresses 1 to $n$ are designated cyclically by the counter 22, a cosine wave is produced continuously from the read-only memory 23. The reference wave C obtained as above in synchronism with the roll eccentricity component and the input P of the unknown phenomena are applied to the correlation detector comprising a sampler 24, a delay circuit 25, a multiplier 26, an averaging circuit 27 and a calculation output memory 28, thus clarifying the roll eccentricity component from the correlation between the reference wave C and the input P of the unknown phenomena.

In this connection, the sampler 24 with its sampling rate controlled by the pulse train $p$ receives the reference wave C and the phenomena P by way of the input terminals X and Y respectively and produces them separately as respective outputs X and Y to the delay circuit 25. The delay circuit 25, the multiplier 26 and the averaging circuit 27 accomplish the calculating operations $$Rp = \lim \frac{1}{T} \int_{o}^{T} C(t)P(t + \tau)dt$$

where $Rp$ is the correlation, $T$ indicates a time when the value of $Rp$ which is a function of $T$ is calculated, $C(t)$ a signal of the reference wave, $P(t + \tau)$ a signal of the unknown phenomena having a delay of $\tau$ and the correlation $Rp$ thus obtained is stored in the calculation output memory 28. This memory 28, in order to circulate the information in harmony with the multiplication speed, has a very high internal clock frequency which itself cannot be used as a real time signal. For the purpose of using the particular signal as a real time signal, therefore, the method mentioned below is employed.

Figure 3:
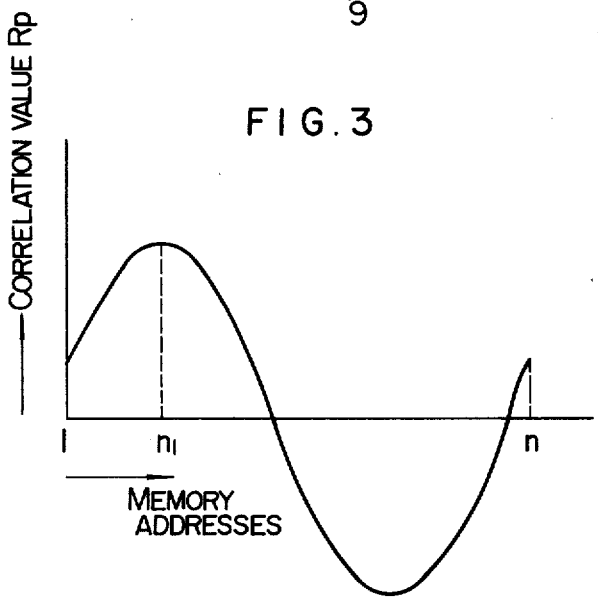
FIG. 3 is a diagram showing an example of the correlation output according to the method of the invention.

The information stored in the memory 28 has the correlation R$p$ which is expressed as illustrated in FIG. 3. Let the reference signal C be $\cos\omega t$ and the signal P of the unknown phenomena $P = P_o\cos(\omega t - \psi) +$ gaussian noise, and the correlation R$p$ is $Rp = P_o/2 \cos(\omega t - \psi)$ where $\psi$ is a delay of the component of the phenomena having the same frequency as that of the reference wave with reference to the phase of the reference wave. It will be seen that the correlation R$p$ contains the information corresponding to the roll eccentricity component of the signal of the unknown phenomena which is quite proportional to the reference signal component. The maximum value of the correlation is stored in the address $n_1$ as shown in FIG. 3. By synchronizing the read pulse with the trigger pulse of the pulse counter 22 thereby to be identical with the maximum value of the cosine wave from the read-only memory 23 and at the same time by rendering the reading speed identical with the delivery speed of the pulse $p$, it is possible to produce the result of real time calculation in a correct phase.

In realizing the above-mentioned method, the calculation output memory 28 is equipped with a plurality of (generally, a couple of) memories 29 and 30 in the form of shift registers. These memories 29 and 30 are alternately used; that is to say, the information stored in the calculation output memory 28 is transferred to the memories 29 and 30 in such a manner that one of the memories 29 and 30 is in read operation while the other is in write operation with the pulse $p$. This process is repeated continuously by alternating between the memories 29 and 30 for read operation. The output thus read out is applied to the OR circuit of the gate 31 and converted into a command value by the D-A converter 32, which is applied to the adding point 10 in the control system, as shown in FIG. 1.

Figure 4:
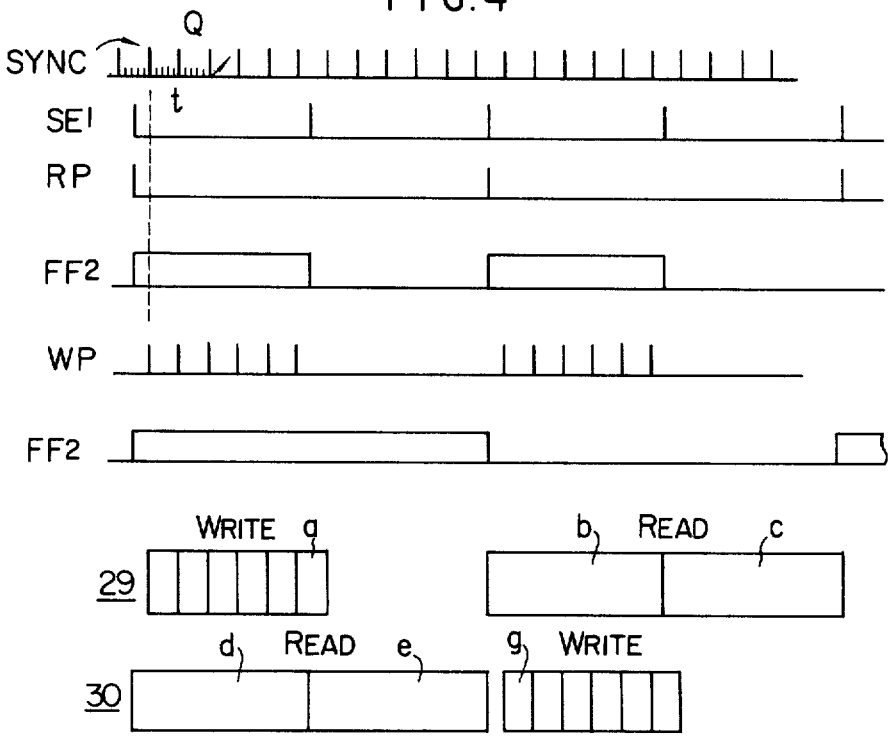
FIG. 4 is a time chart illustrating various pulses produced from a real time output circuit.

The time chart for the memories 29 and 30 is shown in FIG. 4. Symbol SYNC shows a train of pulses which are produced from the correlation detector itself at the pitch of $n$ clock pulses Q. SE1 shows pulses produced by triggering the pulses $p$ from the pulse generator 21 by the pulse counter 22. Symbol RP shows the read pulses for the memories 29 and 30 which are the result of dividing the frequency of the pulses SE1 by two. The read operation is continuously alternated between the memories 29 and 30 by applying the signal RP and the output FF2 of a flip-flop through an AND gate. The pulses RP correspond to and are in phase with the peaks of the cosine wave from the read-only memory 23. On the other hand, the pulses FF1, which are flip-flop output of the trigger pulses, are applied to an AND gate together with the pulses SYNC, and the logic product of the AND gate is used for alternate writing operation between the memories 29 and 30. The information is written in and read out by the memories 29 and 30 at the timing shown in the lower part of the drawing. Incidentally, each of the memories 29 and 30 has $n$ addresses.

Figure 5:
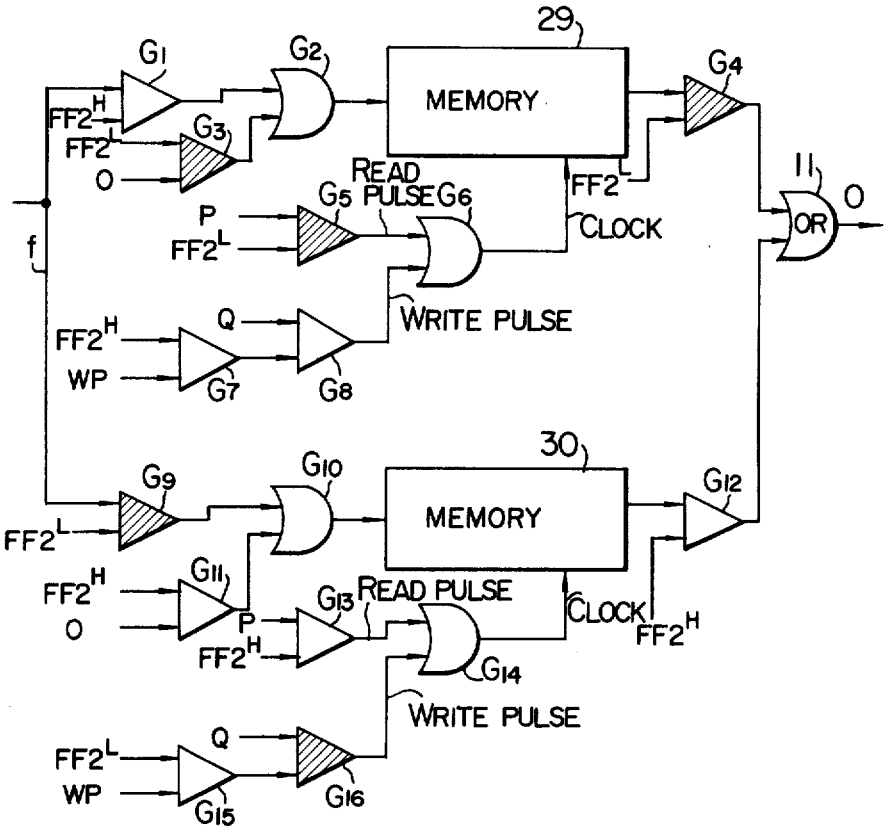
FIG. 5 is a diagram showing logic circuits.

A logic diagram for switching the input and output of the memories 29 and 30 is shown in FIG. 5. Assume that the calculation output memory 28 is producing an output $f$ and the memory 29 is writing while the memory 30 is in read operation. The gate G1 is opened upon application thereto of the H input of the signal FF2, so that the information is stored in the memory 29 through the gate G2. As to the clock pulses to be applied to the memory 29 in the above-mentioned case, the closed state of the gate G5 prevents the read pulses from being applied to the memory 29, whereas the write pulse produced from the pulse FF1 by the trigger pulse is transferred to the memory 29 through the gates G7, G8 and G6. This state is shown by $a$ in 29 of FIG. 4. By the way, the output gate G4 is closed in the state mentioned above. On the other hand, the input $f$ is not applied to the memory 30 since the gate G9 is closed, but the information stored in the memory 30 is delivered sequentially from address 1 thereof in response to the clock pulses applied thereto in real time by the pulses $p$ from the pulse generator 21 through the gates G13 and G14. Under this condition, the output gate 12 is opened and therefore the output signal from the memory 30 is applied through the OR gate 11 to the D-A converter 32. In the example shown, the fact that the information stored in the memory 30 is used twice causes one more transfer to be effected through the gate 11, as shown by $d$ and $e$ of 30 in FIG. 4. After that, the signal FF2 is switched so that the memory 29 is transferred to $b$ and $c$ and the memory 30 to $g$. The above-mentioned processes are repeated continuously, thus producing an output having a correct phase in real time. Further, the roll eccentricity output signal obtained as above is negatively fed back to the gage command circuit in the form of a roll eccentricity compensating signal $e'$, with the result that the reducing device is controlled with a new command $hd - e'$. As a consequence, in spite of the roll eccentricity occurring in actual rolling operation, the material is rolled into proper thickness $hd$ by eliminating the effect of the roll eccentricity.

Figure 6:
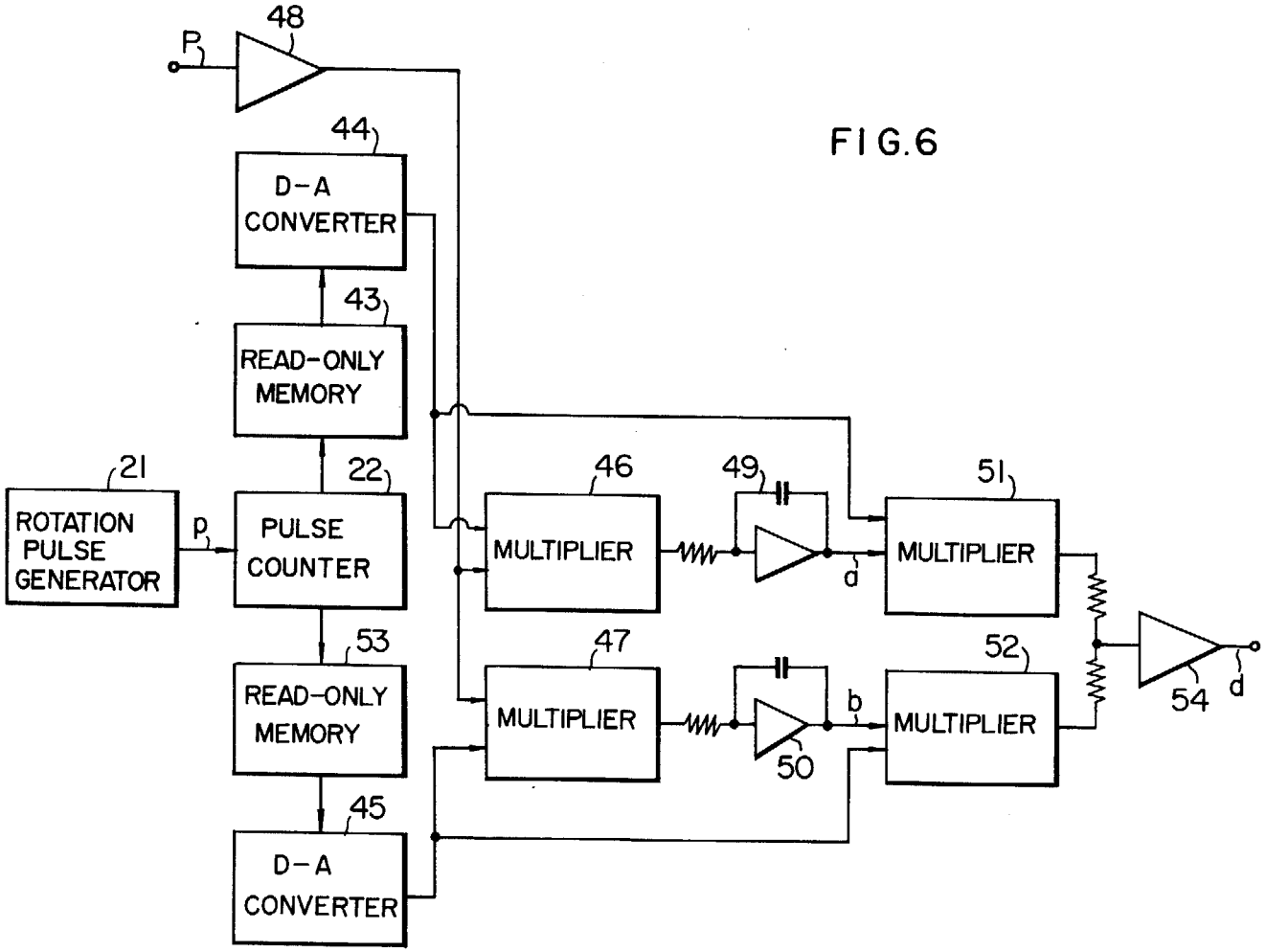
FIG. 6 is a block diagram showing the construction of another embodiment of the invention.

Even though the roll eccentricity signal is obtained by digital operation in the preceding embodiments, the invention is not limited to the digital operation but may be embodied also in analog operation. An embodiment of the invention in which the roll eccentricity signal is obtained by analog correlation is explained below with reference to FIG. 6.

In the drawing under consideration, the pulses associated with the rolls which are generated by the rotation pulse generator 21 are counted by the pulse counter 22, and the result of the counting is applied to the read-only memories 43 and 53. Cosine and sine reference waves are generated in the read-only memories 43 and 53 respectively and, after being converted into analog signals of cosine and sine waves respectively through the D-A converters 44 and 45, applied to the multipliers 46 and 47 respectively. At the same time, the rolling pressure P (or roll gap displacement S) which is a combination of $Po\cos(\omega t - \psi)$ and Gaussian noise is applied through the operational amplifier 48 to the multipliers 46 and 47 where it is multiplied by the cosine wave $\cos\psi t$ and the sine wave $\sin\psi t$ respectively. The result of the multiplication is applied to the low-pass filters 49 and 50, which produce DC outputs of $Po/2\cos\psi$ and $Po/2\sin\psi$ respectively.

These outputs $a$ and $b$ from the low-pass filters 49 and 50 are applied to the multipliers 51 and 52 respectively where they are multiplied by the outputs $\cos\omega t$ and $\sin\omega t$ from the D-A converters 44 and 45 respectively. The results of the multiplications are added to each other in the adder 54, with the result that a desired output $d$ in the form of $(Po/2)\cos(\omega t - \psi)$ is produced at correct phase in real time. This result $d$ of the addition itself represents the correlation R$p$ in real time and therefore may be used to control the roll eccentricity as in the preceding embodiment by negatively feeding back the same to the gage command circuit as a roll eccentricity compensating signal $e'$.

In spite of the fact that a plurality of memories like shift registers are used for producing data outputs in real time in the aforementioned embodiments, the method according to the invention may be embodied in another way capable of real time operation in response to a signal in synchronism with the rotation of the rolls.

Figure 7:
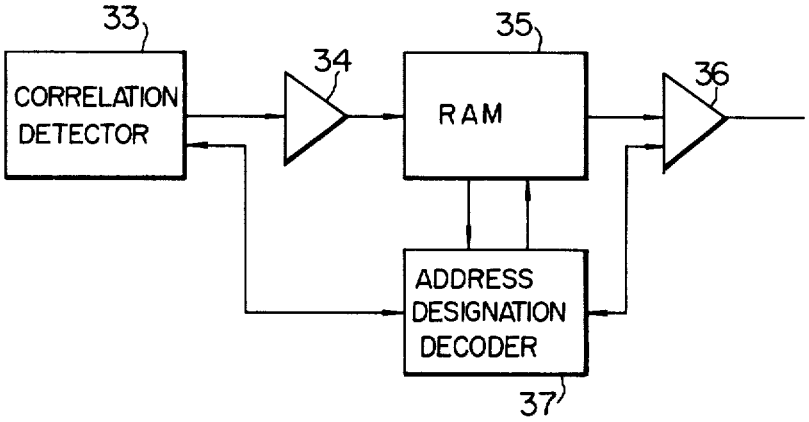
FIG. 7 is a block diagram showing still another embodiment of the invention for producing the correlation output in real time.

The method shown in FIG. 7 utilizes a random access memory 35. In this method, the output of the correlation detector 33 is applied to the random access memory 35 by way of the input gate 34 and produced in real time through the output gate 36 continuously by the use of write and read clock pulses by means of the address degignation decoder 37.

As will be understood from the foregoing description, the invention is characterized in that the correlation between the reference wave in synchronism with the rotation of the rolls and the inputs of unknown phenomena including the roll eccentricity is obtained in real time and dynamically corrected, thus achieving a sufficiently high accuracy and stability in spite of a roll eccentricity.

We claim:

1. A method for controlling the roll eccentricity in a rolling mill during the rolling of material comprising the steps of producing at least one reference input by converting a train of pulses generated in synchronism with the rotation of the rolls into at least one sinusoidal wave, providing an input including a roll eccentricity component during the rolling of material, detecting simultaneously the amplitude and phase of the roll eccentricity from the correlation between the reference input and a roll eccentricity component, and controlling a reducing device in accordance with the detected amplitude and phase.

2. A method according to claim 1, wherein the step of producing includes producing two reference inputs in the form of a cosine wave and a sine wave, multiplying the reference inputs by the input including a roll eccentricity component, filtering the results of the multiplication, multiplying the filtered results of the multiplication with the reference inputs and adding the results of the multiplication.

3. A method according to claim 1, wherein the step of providing an input including a roll eccentricity component includes providing an input signal indicative of the rolling pressure rendered between rolls during the rolling of material.

4. A method according to claim 1, wherein the step of providing an input including a roll eccentricity component includes providing a measurement input of one rolling pressure and roll gap displacement, and the step of detecting simultaneously the amplitude and phase of the roll eccentricity includes producing a command signal in accordance therewith based on the correlation between the reference input and the roll eccentricity component in real time, and controlling the reducing device in accordance with the command signal.

5. A method according to claim 1, wherein the step of detecting simultaneously the amplitude and phase of the roll eccentricity includes storing in at least one memory the correlation between the reference input and the roll eccentricity component and retrieving the correlation as a command signal from the memory upon completion of storage of the correlation in response to the train of pulses, and controlling the reducing device in accordance with the command signal.

6. A method according to claim 5, wherein the number of pulses of the train of pulses for one rotation of the rolls is set at one of the same number and an integral quotient of the number of words in a calculation output memory of a correlation detector, feeding the correlation detector with the reference input and the measurement input including the roll eccentricity component and sampling the inputs to the correlation detector in synchronism with the pulses of the train of pulses, and utilizing the train of pulses as a clock signal for retrieving the correlation stored in the memory.

7. An apparatus for controlling the roll eccentricity in a rolling mill during the rolling of material comprising means for producing at least one reference input by converting rotation pulses in synchronism with the rotation of the rolls into at least one sinusoidal wave, means for providing an input including a roll eccentricity component during the rolling of material, means for simultaneously detecting the amplitude and phase of the roll eccentricity from the correlation between the reference input and the roll eccentricity component, and means for controlling a reducing device in response to the detected amplitude and phase.

8. An apparatus according to claim 7, wherein said means for producing produces reference inputs of a cosine wave and a sine wave, means for multiplying each reference input by said input including a roll eccentricity component, means for filtering each result of the multiplication, means for multiplying each filtered result of the multiplication by a respective reference input, and means for adding the results of the multiplication.

9. An apparatus according to claim 7, wherein said means for providing an input including a roll eccentricity component includes means providing an input signal indicative of rolling pressure between the rolls during the rolling of material.

10. An apparatus according to claim 7, wherein said means for producing includes pulse generating means for generating rotation pulses in synchronism with rotation of the rolls, pulse counter means for counting the pulses from said pulse generating means and for delivering a trigger pulse upon completion of counting a predetermined number of said pulses, at least one read-only memory having a plurality of addresses wherein signals representing amplitudes of respective points of one cycle of the at least one sinusoidal wave are stored, and means for applying the output of said pulse counter means to convert the rotation pulses into at least one sinusoidal wave.

11. An apparatus according to claim 7, wherein said means for simultaneously detecting includes a first pair of multipliers receiving outputs from said means for producing and said means for providing and generating a multiplied output signal, a pair of low-pass filters for separately producing D.C. components of said first multipliers, respectively, a second pair of multipliers for multiplying the outputs of said low-pass filters and said means for producing, and adder means for producing a sum of the outputs of said second multipliers as a signal indicative of the amplitude and phase of the roll eccentricity of the rolls between which the material is passing.

12. An apparatus according to claim 7, wherein said means for simultaneously detecting include delay circuit means for at least delaying the signal including an eccentricity component, multiplier means for producing a signal representative of the product of the output of said delay circuit means and the reference input, and averaging circuit means for producing an output indicative of the average of the product of said multiplier means within a predetermined period.

13. An apparatus according to claim 7, wherein said means for simultaneously detecting the amplitude and phase of the roll eccentricity from the correlation between the reference input and the roll eccentricity component includes a correlation detector for storing the correlation between the reference input and the input including the roll eccentricity component, and a plurality of registers for alternately receiving information from said correlation detector and alternately providing an output signal in accordance therewith, said means for controlling a reducing device being responsive to the output signal from said registers.

14. An apparatus according to claim 13, wherein said means for providing an input including a roll eccentricity component includes one of means for providing an output in accordance with the output gauge and rolling pressure.

* * * * *